US005089161A

United States Patent [19]

Ahmed et al.

[11] Patent Number: 5,089,161

[45] Date of Patent: * Feb. 18, 1992

[54] THIXOTROPIC AQUEOUS LIQUID AUTOMATIC DISHWASHING DETERGENT COMPOSITION

[75] Inventors: Fahim U. Ahmed, Dayton; Charles E. Buck, Caldwell, both of N.J.

[73] Assignee: Colgate-Polmolive Co., Piscataway, N.J.

[ * ] Notice: The portion of the term of this patent subsequent to Nov. 6, 2007 has been disclaimed.

[21] Appl. No.: 570,454

[22] Filed: Aug. 21, 1990

Related U.S. Application Data

[63] Continuation-in-part of Ser. No. 323,134, Jul. 10, 1990, Pat. No. 4,970,016, which is a continuation of Ser. No. 114,911, Oct. 30, 1987, abandoned.

[51] Int. Cl.[5] ..... C11D 7/20; C11D 3/12

[52] U.S. Cl. ..... 252/99; 252/94; 252/135; 252/140; 252/174.25; 252/DIG. 14

[58] Field of Search ..... 252/135, 99, 174.25, 252/DIG. 14, 94, 140

[56] References Cited

U.S. PATENT DOCUMENTS

| | | | |
|---|---|---|---|
| 4,116,851 | 9/1978 | Rupe et al. | 252/103 |
| 4,457,856 | 7/1984 | Mitchell et al. | 252/166 |
| 4,968,445 | 11/1990 | Ahmed et al. | 252/99 |
| 4,968,446 | 11/1990 | Ahmed et al. | 252/99 |
| 4,970,016 | 11/1990 | Ahmed et al. | 252/99 |
| 4,971,717 | 11/1990 | Dixit | 252/174.25 |

FOREIGN PATENT DOCUMENTS 2176495 12/1986 United Kingdom .

*Primary Examiner*—Paul Lieberman
*Assistant Examiner*—Linda D. Skaling
*Attorney, Agent, or Firm*—Richard E. Nanfeldt; Murray Grill; Robert C. Sullivan

[57] ABSTRACT

Thixotropic aqueous liquid automatic dishwashing detergent composition with improved anti-filming properties and method of using the detergent composition. The detergent composition comprises inorganic builder salts, chlorine bleach, bleach-stable detergent and a thixotropic thickener and optionally alumina or titanium dioxide. The compositions provide reduced filming on dishware, glassware, china and the like, particularly in hard water, and remain stable against phase separation.

16 Claims, No Drawings

THIXOTROPIC AQUEOUS LIQUID AUTOMATIC DISHWASHING DETERGENT COMPOSITION

FIELD OF THE INVENTION

The present invention relates to a thixotropic aqueous liquid automatic dishwashing detergent composition with improved anti-filming properties and method of using the detergent composition to clean dishware, glassware, china and the like. The dishwashing composition contains alumina or titanium dioxide, as the anti-filming agent, inorganic builder salts, chlorine bleach, bleach stable detergent and a thixotropic thickener.

The detergent dishwashing composition of the present invention reduce filming on dishware, glassware, china and the like, particularly in hard water, and remains stable against phase separation.

More specifically, the invention relates to the optional use of alumina or titanium dioxide as an anti-filming agent in thixotropic aqueous liquid dishwashing detergent compositions to reduce filming.

The detergent compositions do no require an added rinse aid, are stable in storage, do not settle and are readily redispersible and are pourable.

The present invention also relates to thixotropic aqueous suspension with improved physical stability. The invention relates to the use of long chain fatty acids, metal salts of fatty acids and clay as thixotropic agents for forming stable gel-like liquid suspensions suitable for use as liquid automatic dishwasher detergent composition.

The present invention specifically relates to aqueous liquid automatic dishwashing detergent compositions having thixotropic properties, improved anti-filming and physical stability properties, which are readily dispersible in the washing medium to provide effective cleaning of dishware, glassware, china and the like.

PRIOR ART

Commercially available household-machine dishwasher detergents provided in powder form have several disadvantages, e.g. non-uniform composition; costly operations necessary in their manufacture; tendency to cake in storage at high humidities, resulting in the formation of lumps which are difficult to disperse; dustiness, a source of particular irritation to users who suffer allergies; and tendency to cake in the dishwasher machine dispenser. Liquid forms of dishwashing compositions, however, generally cannot be used in automatic dishwashers due to high foam levels, unacceptably low viscosities and exceedingly high alkalinity.

In addition, the presently used formulated powder detergents frequently require a separate step of hand towel wiping and drying of the dishware, glassware, china and the like to avoid leaving undesirable traces or film of precipitated calcium and magnesium salts. The use of liquid detergent compositions present other problems. The builder salts settle in storage and are not readily redispersed. The compositions also frequently become thicker in storage and are not readily pourable.

Recent research and development activity has focused on the gel or "thixotropic" form of such compositions, however, such compositions have generally proven to be insufficiently viscous to remain "anchored" in the dispenser cup of the dishwasher, and moreover yield spotty residues on dishware, glassware, china and the like. Ideally, thixotropic cleansing compositions should be highly viscous in a quiescent state, Bingham plastic in nature, and have relatively high yield values. When subjected to shear stresses, however, such as being shaken in a container or squeezed through an orifice, they should quickly fluidize and, upon cessation of the applied shear stress, quickly revert to the high viscosity/Bingham plastic state. Stability is likewise of primary importance, i.e. there should be no significant evidence of phase separation or leaking after long standing.

For effective use, it is generally recommended that the automatic dishwashing detergent, hereinafter also designated ADD, contain (1) sodium tripolyphosphate (NaTPP) to soften or tie up hard-water minerals and to emulsify and/or peptize soil; (2) sodium silicate to supply the alkalinity necessary for effective detergency and to provide protection for fine china glaze and pattern; (3) sodium carbonate, generally considered to be optional, to enhance alkalinity; (4) a chlorine-releasing agent to aid in the elimination of soil specks which lead to water spotting; and (5) defoamer/surfactant to reduce foam, thereby enhancing machine efficiency and supplying requisite detergency. See, for example, SDA Detergents in Depth, "Formulations Aspects of machine Dishwashing," Thomas Oberle (1974). Cleansers approximating to the afore-described compositions are mostly liquids or powders. Generally, such compositions omit hypochlorite bleach, since it tends to react with other chemically active ingredients, particularly surfactant, thereby degrading the suspending or thixotropic agent and impairing its effectiveness.

Thus, U.S. Pat. No. 3,985,668 describes abrasive scouring cleaners of gel-like consistency containing (1) suspending agent, preferably the Smectite and attapulgite types of clay; (2) abrasive, e.g. silica sand or perlite; and (3) filler comprising light density powdered polymers, expanded perlite and the like, which has a bouyancy and thus stabilizing effect on the composition in addition to serving as a bulking agent, thereby replacing water otherwise available for undesired supernatant layer formation due to leaking and phase destabilization. The foregoing are the essential ingredients. Optional ingredients include hypochlorite bleach, bleach stable surfactant and buffer, e.g. silicates, carbonates, and monophosphates. Builders, such as NaTPP, can be included as further optional ingredients to supply or supplement building function not provided by the buffer, the amount of such builder not exceeding 5% of the total composition, according to the patent. Maintenance of the desired (greater than) pH 10 levels is achieved by the buffer/builder components. High pH is said to minimize decomposition of chlorine bleach and undesired interaction between surfactant and bleach. When present, NaTPP is limited to 5%, as stated. Foam killer is not disclosed.

In U.K. Patent Application GB 2,116,199A and GB 2,140,450A, both of which are assigned to Colgate-Palmolive, liquid ADD compositions are disclosed which have properties desirably characterizing thixotropic, gel-type structure and which include each of the various ingredients necessary for effective detergency with an automatic dishwasher. The normally gel-like aqueous automatic dishwasher detergent composition having thixotropic properties includes the following ingredients, on a weight basis:

(a) 5 to 35% alkali metal tripolyphosphate;
(b) 0 to 20% sodium silicate;
(c) 0 to 9% alkali metal carbonate;

(d) 0.1 to 5% chlorine bleach stable, water dispersible organic detergent active material;
(e) 0 to 5% chlorine bleach stable foam depressant;
(f) chlorine bleach compound in an amount to provide about 0.2 to 4% of available chlorine;
(g) thixotropic thickener in an amount sufficient to provide the composition with thixotropy index of about 2.5 to 10; and
(h) sodium hydroxide, as necessary, to adjust pH.

ADD compositions so formulated are low-foaming; are readily soluble in the washing medium and most effective at pH values best conducive to improved cleaning performance, viz, pH 10.5–13.5. The compositions are normally of gel consistency, i.e. a highly viscous, opaque jelly-like material having Bingham plastic character and thus relatively high yield values. Accordingly, a definite shear force is necessary to initiate or increase flow, such as would obtain within the agitated dispenser cup of an energized automatic dishwasher or a stream of water. Under such conditions, the composition is quickly fluidized and easily dispensed. When the shear force is discontinued, the fluid composition quickly reverts to a high viscosity, Bingham plastic state closely approximating its prior consistency.

U.S. Pat. No. 4,511,487 dated Apr. 16, 1985 describes a low-foaming detergent paste for dishwashers. The composition is based on a mixture of finely divided hydrated sodium metasilicate, an active chlorine compound and a thickening agent which is a foliated silicate of the hectorite type. Small amount of nonionic tensides and alkali metal carbonates and/or hydroxides may be used.

A related copending application which is assigned to the common assignee is Ser. No. 816,535, filed Jan. 7, 1987 which is incorporated herein in its entirety by reference thereto. The copending application discloses thixotropic aqueous automatic dishwashing detergent composition which contains a long chain fatty acid as a thixotropic thickener agent.

ADVANTAGES OVER THE PRIOR ART

The thixotropic aqueous liquid detergent compositions of the present invention overcome many of the prior art problems associated with powder and liquid detergents. Because of the addition of a small effective amount of an alumina or titanium dioxide anti-filming agent to the composition an added rinse aid is not required and towel wiping and drying are not required to obtain dry sparkling clean dishes, glasses, cups and eating utensils. The thixotropic aqueous liquid detergent composition has the additional advantages of being stable, non-settling in storage and readily redispersible. The liquid compositions of the present invention are easily pourable, easily measured and easily put into the dishwashing machines.

An additional and unexpected advantage of adding the alumina or titanium dioxide anti-filming agent to the detergent formulation is that the alumina or titanium dioxide inhibit brown stain formation in the dishwashing machine. The brown stain is formed by the deposition in the dishwashing machine of iron and/or manganese oxides. The brown stain formation is a particularly serious problem in areas having hard water. The alumina or titanium dioxide in the formulation act on the iron and/or manganese in the wash water to prevent their deposition in the dishwashing machine as iron and/or manganese oxides.

OBJECTS OF THE PRESENT INVENTION

It is an object of the present invention to provide a thixotropic aqueous liquid automatic dishwasher detergent composition that has improved anti-filming properties.

It is another object of the invention to provide a thixotropic aqueous liquid detergent composition which is stable in storage, easily pourable and readily dispersible in the dishwashing water.

A further object of the invention is to provide a method of washing dishware, glassware, china and the like in an automatic dishwashing machine using a thixotropic aqueous liquid detergent composition in which a separate rinse aid is not added or needed.

A still further object of the invention is to provide a method of washing dishware, glassware, china and the like in an automatic washing machine using an aqueous liquid detergent composition by which method the dishware, glassware, china and the like are machine dried without leaving traces, film and spots.

It is a further object of this invention to provide stable aqueous thixotropic aqueous liquid compositions, especially automatic dishwasher detergent compositions, by incorporating in the aqueous suspension a small effective amount of an alumina or titanium dioxide anti-filming agent. There is also added a minor amount of a fatty acid, metal salt of a fatty acid and/or clay thixotropic thickener effective to inhibit the settling of the suspended particles and to prevent phase separation.

DETAILED DESCRIPTION OF THE INVENTION

These and other objects of the invention which will become more readily understood from the following detailed description of the invention and preferred embodiments thereof are achieved by incorporating in an aqueous liquid detergent composition a small but effective amount of an alumina or titanium dioxide anti-filming agent. The physical stability of the composition is improved by the addition of a fatty acid, metal salt of a fatty acid and/or clay thixotropic thickener. More particularly, according to a preferred and specific embodiment of the invention, there is provided a normally gel-like automatic dishwasher detergent composition in which is incorporated from about 0.5 to 5% of an alumina or titanium dioxide anti-filming agent. The alumina or titanium dioxide anti-filming agent has a particle size of about 0.001 to 10 microns. In a preferred embodiment of the invention there is added to the composition a sufficient amount of a long chain fatty acid or metal salt of a long chain fatty acid, or either of the foregoing in admixture with a clay thixotropic thickener to provide a thixotropic index of about 2.5 to 10 and to inhibit settling of the suspended particles, such as alkali metal builder salts, etc.

In accordance with this aspect, the present invention provides a normally gel-like aqueous liquid automatic dishwasher detergent composition having thixotropic properties which includes, on a weight basis:
(a) 5 to 35% alkali metal tripolyphosphate;
(b) 0 to 40% sodium silicate;
(c) 0 to 5% alumina or titanium dioxide anti-filming agent;
(d) 0 to 9% alkali metal carbonate;
(e) 0.1 to 5% chlorine bleach stable, water dispersible organic detergent active material;
(f) 0 to 5% chlorine bleach stable foam depressant;

(g) chlorine bleach compound in an amount to provide about 0.2 to 4% of available chlorine;
(h) thixotropic thickener in an amount sufficient to provide a thixotropic index of about 2.5 to 10.
(i) 0 to 8% sodium hydroxide; and
(j) balance water.

Also related to this specific aspect, the invention provides a method for cleaning dishware in an automatic dishwashing machine with an aqueous wash bath containing an effective amount of the liquid automatic dishwasher detergent (LADD) composition as described above. According to this aspect of the invention, the LADD composition can be readily poured into the dispensing cup of the automatic dishwashing machine and will, within just a few seconds, promptly thicken to its normal gel-like or pasty state to remain securely within the dispensing cup until shear forces are again applied thereto, such as by the water spray from the dishwashing machine.

The invention will now be described in greater detail by way of specific embodiments thereof.

The LADD products of for example the prior disclosure in the aforementioned GB 2,116,199A and GB 2,140,450A exhibit rheological properties as evaluated by testing product viscosity as a function of shear rate. The compositions exhibited higher viscosity at a low shear rate and lower viscosity at a high shear rate, the data indicating efficient fluidization and gellation well within the shear rates extant within the standard dishwasher machine. In practical terms, this means improved pouring and processing characteristics as well as less leaking in the machine dispenser-cup, compared to prior liquid or gel ADD products. For applied shear rates corresponding to 3 to 30 rpm, viscosities (Brookfield) correspondingly ranged from about 10,000 to 30,000 cps to about 3,000 to 7,000 cps, as measured at room temperature by means of an LVT Brookfield viscometer after 3 minutes using a No. 4 spindle. A shear rate of 7.4 $sec^{-1}$ corresponds to a spindle rpm of about 3. An approximate 10-fold increase in shear rate produces about a 3- to 9-fold reduction in viscosity. The compositions of the assignee's prior invention thus exhibit threshold fluidizations at lower shear rates and of significantly greater extent in terms of incremental increases in shear rate versus incremental decrease in viscosity. This property of the LADD products of the prior invention is summarized in terms of a thixotropic index (TI) which is the ratio of the apparent viscosity at 3 rpm and at 30 rpm. The prior compositions have a TI of from 2 to 10. The LADD compositions should exhibit substantial and quick return to prior quiescent state consistency when the shear force is discontinued.

In terms of apparent viscosity, it has been ascertained that so long as the viscosity at room temperature (22°±1° C.) measured in a Brookfield Viscosimeter HATD, using a number 4 spindle at 20 rpm, is less than about 20,000 cps, the composition can be readily shaken so that a thixotropic composition can be easily "fluidized" or "liquefied" to allow the product to be dispensed through a conventional squeeze tube bottle or other convenient dispenser.

The present invention is based upon the surprising discovery that substantially improved anti-filming properties can be obtained by adding to the thixotropic aqueous liquid detergent composition a small effective amount of an alumina or titanium dioxide anti-filming agent. The physical stability, i.e., resistance to phase separation, settling, etc. can be achieved by adding to the composition a small effective amount of a thixotropic thickener and stabilizing agent.

ANTI-FILMING AGENTS

The alumina or titanium dioxide anti-filming agent materials that can be optionally used are readily commercially available. The alumina material that can be used as an anti-filming agent is insoluble in water and has the formula $Al_2O_3$. Suitable materials are available under the tradenames Alumina Oxide C, available from Degussa Company and Catapal D, available from Vista Corp. Preferred alumina materials are fumed alumina and a precipitated alumina.

The titanium dioxide material that can be used as an anti-filming agent is insoluble in water and has the formula $TiO_2$. Suitable materials are available under the tradenames Titanium Dioxide P25, available from Degussa Co. Preferred titanium dioxide materials are fumed titanium dioxide and precipitated titanium dioxide.

The particle size of the alumina and titanium dioxide material that is used is important in achieving the desired anti-filming properties.

The alumina or titanium dioxide particles that are used are finely divided and can have a particle size of about 0.001 to 10 microns, preferably 0.010 to 8 microns and more preferably about 0.020 to 4.0 microns. For example, a suitable particle size is about 0.01 to 0.50 microns. The alumina and titanium dioxide particles of this size and in the amount used herein are not abrasive.

The finely divided alumina or titanium dioxide material particles in the dishwashing wash act to coagulate proteinaceous particulate soils and keeps them in suspension to prevent them from depositing on the clean glass and dishware.

Without intending to limit the invention in anyway it is theorized that the alumina and titanium dioxide anti-filming agents function in the following manner. The glass surface of vitreous glassware contain negative charges on their surface through the Si-O bonds. Usually the oxygen atoms carry these charges. It is postulated that these negatively charged ions will attract positively charged particles and thereby will form an "artificial soil" layer. This protective mono-layer will then repel the regular food soil and will increase the anti-redeposition property of the automatic dishwashing detergent. The alumina and titanium dioxide particles, respectively, will generate positively charged particles which will bond themselves to the glassware surface to form the artificial soil layer which will prevent the formation of film.

The amount of alumina or titanium dioxide anti-filming agent that can be used to achieve the desired improvement in film will depend on the hardness of the water, detergent active compound, inorganic salts and other ADD ingredients. The alumina or titanium dioxide anti-filming agent is particularly effective in hard wash water of, for example, 300 ppm hardness or more.

The amount of alumina or titanium dioxide anti-film agent that is used can be about 0.5 to 5%, preferably about 1 to 4% and more preferably about 1.5 to 3% by weight based on the weight of the entire composition.

The alumina and titanium dioxide can each be used alone or can be used mix together and/or mix with the silica anti-filming agent disclosed in applicants' copending related application Ser. No. 102,205 (IR4414) filed Sept. 29, 1987, which is incorporated herein in its entirety by reference thereto. When the anti-filming agents are used mixed together the weight percent amounts mentioned above are the total for the ingredients in the mixture.

THIXOTROPIC THICKENERS

The thixotropic thickeners or suspending agents that can be used in accordance with the present invention to provide the aqueous medium with thixotropic properties may be organic, for example, fatty acid or fatty acid polyvalent metal salts and/or inorganic colloid forming clay materials. The thixotropic thickeners should be stable to high alkalinity and stable to chlorine bleach compounds such as sodium hypochlorite. The preferred thixotropic thickeners comprise the fatty acids, the fatty acid polyvalent metal salts and the inorganic, colloid-forming clays of smectite and/or attapulgite types. The amount of the thixotropic thickener used will depend on the particular thickener used, but sufficient thickener is added to the formulation to provide the composition with a thixotropy index of about 2.5 to 10.

The preferred fatty acid thixotropic thickeners are the higher aliphatic fatty monocarboxylic acids having from about 8 to about 22 carbon atoms, more preferably from about 10 to 20 carbon atoms, and especially preferably from about 12 to 18 carbon atoms, inclusive of the carbon atom of the carboxyl group of the fatty acid. The aliphatic radical may be saturated or unsaturated and may be straight or branched. Straight chain saturated fatty acids are preferred. Mixtures of fatty acids may be used, such as those derived from natural sources, such as tallow fatty acid, coco fatty acid, soya fatty acid, etc., or from synthetic sources available from industrial manufacturing processes.

Thus, examples of the fatty acids which can be used as thickeners include, for example, decanoic acid, lauric acid, dodecanoic acid, palmitic acid, myristic acid, stearic acid, oleic acid, eicosanoic acid, tallow fatty acid, coco fatty acid, soya fatty acid and mixtures of these acids. Stearic acid and mixed fatty acids, e.g. coco fatty acid, are preferred.

While the fatty acids as described hereinabove may be used as such, it is also contemplated, and is within the scope of the invention, to include the fatty acids in the form of their salts with monovalent or polyvalent metals, or as a derivative of the fatty acid or fatty acid salt. Examples of suitable derivatives include those fatty acids or fatty acid salts that have one or more substituents on the aliphatic chain of the fatty acid, such as, for example, hydroxyl, alkoxyl, ester, dialkylamide, carboxyl, benzyl, and aromatic, e.g. phenyl, groups, including mixtures thereof.

The amount of the fatty acid thickener to achieve the desired values of thixotropy and physical stability will depend on such factors as the nature of the fatty acid, detergent active compound, inorganic salts, especially TPP, other LADD ingredients, as well as the anticipated storage and shipping conditions.

Generally, however, amounts of the fatty acid thixotropic agent that can be used are in the range of from about 0.03 to 0.5%, preferably from about 0.03 to 0.2%, especially preferably from about 0.05 to 0.15%, provide the desired long term stability and absence of phase separation.

The polyvalent metal salts of the above fatty acids can also be used in the present invention as thixotropic thickener agents. Suitable metal salt thixotropic thickeners are disclosed in the prior application Ser. No. 903,924 filed Sept. 5, 1986 in the name of Drapier et al., which is incorporated herein in its entirety by reference thereto.

The preferred metals are the polyvalent metals such as magnesium, calcium, aluminum and zinc.

Generally, the metals may be present in the divalent to pentavalent state. Preferably, the metal salts are used in their higher oxidation states. Naturally, for LADD compositions, as well as any other applications where the invention composition will or may come into contact with articles used for the handling, storage or serving of food products or which otherwise may come into contact with or be consumed by people or animals, the metal salt should be selected by taking into consideration the toxicity of the metal. For this purpose, the calcium and magnesium salts are especially highly preferred as generally safe food additives.

Many of these metal salts are commercially available. For example, the aluminum salts are available in the triacid form, e.g. aluminum stearate as aluminum tristearate, $Al(C_{17}—H_{35}COO)_3$. The monoacid salts, e.g. aluminum monostearate, $Al(OH)_2(C_{17}H_{35}COO)$ and diacid salts, e.g. aluminum distearate, $Al(OH)C_{17}H_{35}COO)_2$, and mixtures of two or three of the mono-, di- and tri-acid salts can be used for those metals, e.g. Al, with valences of +3, and mixtures of the mono- and di-acid salts can be used for those metals, e.g. Zn, with valences of +2. It is more preferred that the diacids of the +2 valent metals and the triacids of the +3 valent metals, the tetraacids of the +4 metals, and the pentacids of the +5 valent metals, be used in predominant amounts. For example, at least 30%, preferably at least 50%, especially preferably from 80 to 100% of the total metal salt should be in the highest possible oxidation state, i.e. each of the possible valence sites is occupied by a fatty acid residue.

The metal salts, as mentioned above, are generally commercially available but can be easily produced by, for example, saponification of a fatty acid, e.g. animal fat, stearic acid, etc., or the corresponding fatty acid ester, followed by treatment with an hydroxide or oxide of the polyvalent metal, for example, in the case of the aluminum salt, with alum, alumina, etc.

Calcium stearate, i.e. calcium distearate, magnesium stearate, i.e. magnesium distearate, aluminum stearate, i.e. aluminum tristearate, and zinc stearate, i.e. zinc distearate, are the preferred polyvalent fatty acid salt stabilizers. Mixed fatty acid metal salts, such as the naturally occurring acids, e.g. coco acid, as well as mixed fatty acids resulting from the commercial manufacturing process are also advantageously used as an inexpensive but effective source of the long chain fatty acid.

The amount of the fatty acid salt stabilizers to achieve the desired enhancement of physical stability will depend on such factors as the nature of the fatty acid salt, the nature and amount of the thixotropic agent, detergent active compound, inorganic salts, especially TPP, other LADD ingredients, as well as the anticipated storage and shipping conditions.

Generally, however, amounts of the polyvalent metal fatty acid salt stabilizing agents in the range of from about 0.02 to 1%, preferably from about 0.06 to 0.8%, especially preferably from about 0.08 to 0.4%, provide the long term stability and absence of phase separation upon standing or during transport at both low and elevated temperatures as are required for a commercially acceptable product.

There may also be used in the present invention the conventional inorganic thixotropic clay thickeners. The clay thickeners may be used in small amounts in combination with the fatty acid thickeners or in combination with fatty acid polyvalent metal salt thickeners. The clay thickeners, however, may be used by themselves as the thixotropic thickeners.

The preferred clay thickeners comprise the inorganic, colloid forming clays of smectite and/or attapulgite types.

Smectite clays include montmorillonite (bentonite), hectorite, attapulgite, smectite, saponite, and the like. Montmorillonite clays are preferred and are available under tradenames such as Thixogel (Registered Trademark) No. 1 and Gelwhite (Registered Trademark) GP, H, etc., from Georgia Kaolin Company; and Eccagum (Registered Trademark) GP, H, etc., from Luthern Clay Products. Attapulgite clays include the materials commercially available under the tradename Attagel (Registered Trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. Thickening or suspending agents of the foregoing types are well known in the art, being described, for example, in U.S. Pat. No. 3,985,668 referred to above. Abrasives or polishing agents should be avoided in the LADD compositions as they may mar the surface of fine dishware, crystal and the like.

When used in combination with the fatty acids or the fatty acid polyvalent metal salts, the clay thixotropic thickeners are used in amounts of 0.1 to 3%, preferably 0.1 to 2.5% and more preferably in amounts of 0.1 to 2%.

When the clay thixotropic thickeners are used alone as the thixotropic thickener agent they can be used in amounts of about 1.5 to 8%, preferably 2 to 5% by weight of the formulation.

Generally, LADD effectiveness is directly related to (a) available chlorine levels; (b) alkalinity; (c) solubility in washing medium; and (d) foam inhibition. It is preferred herein that the pH of the LADD composition be at least about 9.5, more preferably from about 10.5 to 13.5 and most preferably at least about 11.5. At the relatively lower pH values, the LADD product is too viscous, i.e. solid-like, and thus not readily fluidized under the shear-force levels created within the dispenser cup under normal machine operating conditions. Addition of NaOH is thus often needed to increase the pH to within the above ranges, and to increase flowability properties. The presence of carbonate is also often needed herein, since it acts as a buffer helping to maintain the desired pH level. Excess carbonate is to be avoided, however, since it may cause the formation of needle-like crystals of carbonate, thereby imparing the stability, thixotropy and/or detergency of the LADD product, as well as impairing the dispensibility of the product from, for example, squeeze tube bottles. Caustic soda (NaOH) serves the further function of neutralizing the phosphoric or phosphonic acid ester foam depressant when present. About 0.5 to 3 wt % of NaOH and about 2 to 9 wt % of sodium carbonate in the LADD composition are typical, although it should be noted that sufficient alkalinity may be provided by the NATPP and sodium silicate.

The NaTPP may be employed in the LADD composition in a range of about 8 to 35 wt %, preferably about 20 to 30 wt %, and should preferably be free of heavy metal which tends to decompose or inactivate the preferred sodium hypochlorite and other chlorine bleach compounds. The NaTPP may be anhydrous or hydrated, including the stable hexahydrate with a degree of hydration of 6 corresponding to about 18% by weight of water or more. Actually, in view of the stability of the hexahydrate, the presence of some water of hydration is highly effective, serving it is thought to form seeds of the stable hexahydrate which expedites hydration and solubilization of the remaining NaTPP particles. If only the hexahydrate is used, the detergent product may be too liquid. Conversely, if only the anhydrous NaTPP is used, the product may, in some cases, be too thick and, therefore, unsuitable. Especially preferred LADD compositions are obtained, for example, when using a 0.5:1 to 2:1 weight ratio of anhydrous to hexahydrated NaTPP, values of about 1:1 being particularly preferred.

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of NaTPP which has a water softening effect may aid in providing the desired degree of foam inhibition. However, it is generally preferred to include a chlorine bleach stable foam depressant or inhibitor. Particularly effective are the alkyl phosphonic acid esters of the formula

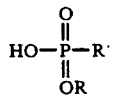

available for example from BASF-Wyandotte (PCUK-PAE), and especially the alkyl acid phosphate esters of the formula

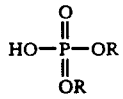

available, for example, from Hooker (SAP) and Knapsack (LPKn-158), in which one or both R groups in each type of ester may represent independently a $C_{12-20}$ alkyl group. Mixtures of the two types, or any other chlorine bleach stable types, or mixtures of mono- and di-esters of the same type, may be employed. Especially preferred is a mixture of mono- and di-$C_{16-18}$ alkyl acid phosphate esters such as monostearyl/distearyl acid phosphates 1.2/1 (Knapsack). When employed, proportions of 0.01 to 5 wt %, preferably 0.1 to 5 wt %, especially about 0.1 to 0.5 wt %, of foam depressant in the composition is typical, the weight ratio of detergent active component to foam depressant generally ranging from about 10:1 to 1:1 and preferably about 4:1 to 1:1. Other defoamers which may be used include, for example, the known silicones.

Although any chlorine bleach compound may be employed in the compositions of this invention, such as dichloro-isocyanurate, dichloro-dimethyl hydantoin, or chlorinated TSP, alkali metal, e.g. potassium, lithium, magnesium and especially sodium hypochlorite is preferred. The composition should contain sufficient chlorine bleach compound to provide about 0.2 to 4.0% by weight of available chlorine, as determined, for example, by acidification of 100 parts of the composition with excess of hydrochloric acid. A solution containing about 0.2 to 4.0% by weight of sodium hypochlorite contains or provides roughly the same percentage of available chlorine. A solution containing about 0.8 to 1.6% by weight sodium hypochlorite contains about 0.8 to 1.6% by weight of available chlorine and is especially preferred. For example, sodium hypochlorite (NaOCl) solution of from about 11 to about 13% available chlorine in amounts of about 3 to 20%, preferably about 7 to 12%, can be advantageously used.

The sodium silicate, which provides alkalinity and protection of hard surfaces, such as fine china glaze and pattern, is employed in an amount ranging from about 2.5 to 40 wt %, preferably about 10 to 35 wt %, in the composition. The sodium silicate also protects the internal washing machine parts from corrosion. At the higher levels specified herein for example at levels greater than about 10 wt % the silicate also provides increased antispotting action. The sodium silicate is generally added in the form of an aqueous solution, preferably having an $Na_2O:SiO_2$ ratio of about 1:2.2 to 1:2.8, for example, 1:2.4. Most of the other components of the composition, especially NaOH, sodium hypochlorite and foam depressant may also be added in the form of an aqueous dispersion or solution.

Detergent active material useful herein must be stable in the presence of chlorine bleach, especially hypochlorite bleach, and those of the organic anionic, amine oxide, phosphine oxide, sulphoxide or betaine water dispersible surfactant types are preferred, the first mentioned anionics being most preferred. They are used in amounts ranging from about 0.1 to 5% preferably about 0.3 to 2.0%. Particularly preferred surfactants herein are the linear or branched alkali metal mono- and/or di-($C_{8-14}$) alkyl diphenyl oxide mono and/or disulfonates, commercially available for example as DOWFAX (Registered Trademark) 3B-2 and DOWFAX 2A-1.

In addition, the surfactant should be compatible with the other ingredients of the composition. Other suitable surfactants include the primary alkylsulphates, alkylsulphonates, alkylaryl-sulphonates and sec.-alkylsulphates. Examples include sodium $C_{10-18}$ alkylsulphates such as sodium dodecylsulphate and sodium tallow alcoholsulphate; sodium $C_{10-18}$ alkanesulphonates such as sodium hexadecyl-1-sulphonate and sodium $C_{12-18}$ alkylbenzenesulphonates such as sodium dodecylbenzenesulphonates. The corresponding potassium salts may also be employed.

As other suitable surfactants or detergents, the amine oxide surfactants are typically of the structure $R_2R^1NO$, in which each R represents a lower alkyl group, for instance, methyl, and $R^1$ represents a long chain alkyl group having from 8 to 22 carbon atoms, for instance a lauryl, myristyl, palmityl or cetyl group. Instead of an amine oxide, a corresponding surfactant phosphine oxide $R_2R^1PO$ or sulphoxide $RR^1SO$ can be employed. Betaine surfactants are typically of the structure $R_2R^1NR''COO^-$, in which each R represents a lower alkylene group having from 1 to 5 carbon atoms. Specific examples of these surfactants are lauryl-dimethylamine oxide, myristyldimethylamine oxide, the corresponding phosphine oxides and sulphoxides, and the corresponding betaines, including dodecyldimethylammonium acetate, tetradecyldiethylammonium pentanoate, hexadecyl-dimethylammonium hexanoate and the like. For biodegradability, the alkyl groups in these surfactants should be linear, and such compounds are preferred.

Surfactants of the foregoing type, all well known in the art, are described, for example, in U.S. Pat. Nos. 3,985,668 and 4,271,030.

The amount of water contained in these compositions should, of course, be neither so high as to produce unduly low viscosity and fluidity, nor so low as to produce unduly high viscosity and low flowability, thixotropic properties in either case being diminished or destroyed. Such amount is readily determined by routine experimentation in any particular instance, generally ranging from about 25 to 75 wt %, preferably about 50 to 65 wt %. The water should also be preferably deionized or softened. These amounts of water in the composition include the water added as parts of the liquid solutions of other ingredients, but do no include bound water, for example that in NaTPP hexahydrate.

Other conventional ingredients may be included in these compositions in small amounts, generally less than about 3 wt %, such as perfume, hydrotropic agents such as the sodium benzene, toluene, xylene and cumene sulphonates, preservatives, dyestuffs and pigments and the like, all of course being stable to chlorine bleach compound and high alkalinity (properties of all the components). Especially preferred for coloring are the chlorinated phthalocyanines and polysulphides of aluminosilicate which provide, respectively, pleasing green and blue tints.

The liquid ADD compositions of this invention are readily employed in known manner for washing dishes, glasses, cups, eating utensils and the like in an automatic dishwasher, provided with a suitable detergent dispenser, in an aqueous wash bath containing an effective amount of the composition.

In a preferred embodiment of the invention the aqueous liquid dishwashing detergent composition is formulated using the below named ingredients.

| Component | Weight Percent |
|---|---|
| Alkali Metal Tripolyphosphate | 10–25 |
| Sodium Silicate (47.5%) | 15–40 |
| Alumina or Titanium Dioxide Anti-filming Agent | 1–4 |
| Alkali Metal Carbonate (anhydrous) | 2–8 |
| Chlorine Bleach Stable, Water Dispersible Organic Detergent Active Material | 0.5–3 |
| Chlorine Bleach Stable Foam Depressant | 0.10–3 |
| Sodium Hypochlorite Bleach Compound | 0.2–4 |
| Fatty Acid Thixotropic Thickener | 0.03–0.5 |
| Sodium Hydroxide (50%) | 2–6 |
| Balance Water | — |

The thixotropic aqueous liquid automatic dishwashing detergent compositions of the present invention can contain conventional dishwashing detergent composition additives. The formulations can be prepared with commercially available solid powder builders, and/or the ingredients can be mixed and the formulations ground to a desired particle size.

The invention may be put into practice in various ways and a number of specific embodiments will be described to illustrate the invention with reference to the accompanying examples.

All amounts and proportions referred to herein are percent by weight of the composition unless otherwise indicated.

The present invention is further illustrated by the following examples.

EXAMPLE 1

A thixotropic aqueous liquid automatic dishwashing detergent composition is formulated from the following ingredients in the amounts specified.

| Component | Weight Percent |
|---|---|
| Deionized Water | 39.04 |
| Knapsack LPKN-158 Foam Depressant[1] | 0.16 |
| Sodium Hydroxide (50%) | 2.34 |
| Sodium Carbonate (anhydrous) | 4.88 |
| Sodium Tripolyphosphate (anhydrous) | 11.70 |
| Sodium Tripolyphosphate (hexahydrate) | 11.70 |
| Alumina Anti-filming Agent[2] | 2.50 |
| Gel White H Clay | 1.22 |
| Aluminum Stearate Thixotropic Thickener | 0.09 |
| Dowfax 3B-2 Surfactant[3] | 0.78 |
| Sodium Hypochlorite (11%) | 8.78 |
| Sodium Silicate (1/2.23–43.5%) | 16.81 |
| | 100.00 |

[1]Mixture of mono and distearyl ($C_{16}$-$C_{18}$) alkyl ester of phosphoric acid, mole ratio 1:1.3.
[2]Aluminum Oxid C has a particle size of about 0.02 microns and is available from Degussa Co.
[3]Na mono- and didecyl diphenyl ether disulfonate (45% solution).

The ingredients are mixed following the procedure of the copending commonly assigned application Ser. No. 903,924 filed Sept. 5, 1986, which is incorporated herein in its entirety by reference thereto.

The formulation is tested by washing glassware and dishware at a temperature of 120° F. in hard water (300 ppm hardness) in an automatic dishwashing machine and the clean and dried dishes are found to have no apparent film.

EXAMPLE 2

In order to demonstrate the effect of adding the alumina or titanium dioxide anti-filming agent, formulations are prepared with and without the alumina and titanium dioxide anti-filming agent and are compared to a commercially available powder detergent composition.

The compositions are formulated to contain the following ingredients.

| Component | (A) Alumina Anti-film Agent | (B) Titanium Dioxide Anti-film Agent | (C) No Anti-film Agent |
|---|---|---|---|
| Deionized Water | 39.04 | 39.04 | 40.27 |
| Knapsack LPKN-158 Foam Depressant | 0.16 | 0.16 | 0.16 |
| Sodium Hydroxide (50%) | 2.34 | 2.34 | 2.40 |
| Sodium Carbonate (anhydrous) | 4.88 | 4.88 | 5.00 |
| Sodium Tripolyphosphate (anhydrous) | 11.70 | 11.70 | 12.0 |
| Sodium Tripolyphosphate (hexahydrate) | 11.70 | 11.70 | 12.0 |
| Anti-filming Agent | 2.50 | 2.50 | — |
| Gel White H Clay | 1.22 | 1.22 | 1.25 |
| Aluminum Stearate Thixotropic Thickener | 0.09 | 0.09 | 0.10 |
| Dowfax 3B-2 Surfactant | 0.78 | 0.78 | 0.80 |
| Sodium Hypochlorite (11%) | 8.78 | 8.78 | 8.78 |
| Sodium Silicate (1/2.23–43.5%) | 16.81 | 16.81 | 17.24 |
| | 100.00 | 100.00 | 100.00 |

The ingredients are mixed in a conventional manner or can be mixed following the procedure of the copending commonly assigned application Ser. No. 903,924 filed Sept. 5, 1986, which is incorporated herein in its entirety by reference thereto.

The formulations are tested by washing glassware at 120° F. in hard water (300 ppm hardness).

The three above formulations (A), (B) and (C) were tested in a Kenmore automatic dishwasher using the procedure described in ASTMD 3566-79, except that only four cleaning cycles are used. The spotting and filming are evaluated according to the following scales:

Film Rating Scale

1. Best, no apparent film
2. Filming slight, becoming apparent
3. Noticeable film, increasing
4. Continued increase of significant film
5. Filming becoming excessive
6. Filming high, excessive buildup
7. Continued increase of excessive film.

Spot Rating Scale

A. Best—no spots
B. Very few spots apparent
C. Distinct Spots
D. Significant coverage approximately 50%.

The results obtained in the fourth cycle are reported in the below Table 1.

TABLE 1

| Formulation | Performance Rating Spot | Performance Rating Film |
|---|---|---|
| (A) Alumina Anti-filming Agent | B | 2–3 |
| (B) Titanium Dioxide Anti-filming Agent | B | 2–3 |
| (C) No Anti-filming Agent | B | 4 |

The products (A), (B) and (C) left very few spots on glasswares and were rated B. The product (C) with no anti-film additive left a significant uniform film 4 on glasswares. Significant filming improvements were obtained with both alumina and titanium dioxide.

EXAMPLE 3

A thixotropic aqueous liquid automatic dishwashing detergent composition is formulated from the following ingredients in the amounts specified.

| Component | Weight Percent |
|---|---|
| Deionized Water | 32.8 |
| Foam Depressant[1] | 0.16 |
| Sodium Hydroxide (50%) | 2.34 |
| Sodium Carbonate (Anhydrous) | 4.88 |
| Sodium Tripolyphosphate (anhydrous) | 11.70 |
| Sodium Tripolyphosphate (hexahydrate) | 11.70 |
| Alumina Anti-film Agent | 2.50 |
| Stearic Acid Thixotropic Thickener | 0.10 |
| Dowfax 3B-2 Surfactant | 0.60 |
| Sodium Hypochlorite (11%) | 7.61 |
| Sodium Silicate (1/2.4–47.5%) | 25.60 |

-continued

| Component | Weight Percent |
|---|---|
| Graphitol Green | 0.01 |
| | 100.00 |

(1)1:1 mixture of LPKN-158 and PCUK-PAE.

The stearic acid is melted and the ingredients are added to the water generally in the order listed and gently stirred until a homogeneous mixture is obtained.

The formulation is tested by washing glassware at 130° F. in hard water (300 ppm hardness) in an automatic dishwashing machine. The clean and dried glassware are found to have no apparent film.

The thixotropic aqueous liquid automatic dishwashing detergent compositions of the present invention provide improved film properties. The invention is not to be limited by the above disclosure and Examples which are given as illustrations only. The invention is to be interpreted in accordance with the below claims.

What is claimed is:

1. A gel-like thixotropic aqueous liquid automatic dishwashing detergent composition comprising water, at least one ingredient selected from the group consisting of organic detergent, bleach, detergent builder, sequestering agent, foam inhibitors, and mixtures thereof, from about 0.5 to 5% of an alumina or titanium dioxide or mixture thereof non-abrasive anti-filming agent and a sufficient amount of a thixotropic thickener to provide a thixotropic index of about 2.5 to 10 said anti-filming agent having a particle size of about 0.01 to about 0.5 microns.

2. The composition of claim 1 wherein the alumina or titanium dioxide anti-filming is in an amount of about 1 to 4%.

3. A thixotropic aqueous liquid automatic dishwasher composition comprising approximately by weight:

(a) 5 to 35% detergent builder;
(b) 0 to 40% sodium silicate;
(c) 0.5 to 5% of an alumina or titanium dioxide non-abrasive anti-filming agent having a particle size of about 0.001 to 0.5 microns;
(d) 0 to 9% alkali metal carbonate;
(e) 0.1 to 5% chlorine bleach stable, water-dispersible organic detergent active material;
(f) 0 to 5% chlorine bleach stable foam depressant;
(g) chlorine bleach compound in an amount to provide about 0.2 to 4% of available chlorine;
(h) a sufficient amount of a thixotropic thickener to provide a thixotropic index of about 2.5 to 10.
(i) 0 to 8% of sodium hydroxide;
(j) balance water.

4. The composition of claim 3 wherein the thixotropic thickener comprises a long chain fatty acid in an amount of about 0.03 to 0.5%.

5. The composition of claim 3 wherein the thixotropic thickener comprises a polyvalent metal salt of a long chain fatty acid in an amount of about 0.02 to 1.0%.

6. The composition of claim 4 additionally comprising a clay thixotropic thickener in an amount of about 0.1 to 3.0%.

7. The composition of claim 5 additionally comprising a clay thixotropic thickener in an amount of about 0.1 to 3.0%.

8. The composition of claim 3 wherein the alumina or titanium dioxide has a particle size of 0.01 to 0.50 microns.

9. A thixotropic aqueous liquid automatic dishwasher composition comprising approximately by weight:

(a) 5 to 35% alkali metal tripolyphosphate;
(b) 0 to 40% sodium silicate;
(c) 0.5 to 4% an alumina or titanium dioxide non-abrasive anti-filming agent having a particle size of about 0.010 to 0.5 microns;
(d) 0 to 9% alkali metal carbonate;
(e) 0.1 to 5% chlorine bleach stable, water dispersible organic detergent active material;
(f) 0 to 5% chlorine bleach stable foam depressant;
(g) chlorine bleach compound in an amount to provide about 0.2 to 4% of available chlorine;
(h) a sufficient amount of a thixotropic thickener to provide a thixotropic index of about 2.5 to 10;
(i) 0 to 8% of sodium hydroxide; and
(j) balance water.

10. The composition of claim 9 wherein the thixotropic thickener comprises a long chain fatty acid having $C_{16}$ to $C_{20}$ carbon atoms in an amount of about 0.03 to 0.20%.

11. The composition of claim 9 wherein the thixotropic thickener comprises a polyvalent metal salt of a long chain fatty acid having $C_{16}$ to $C_{20}$ carbon atoms in an amount of about 0.06 to 0.8%.

12. The composition of claim 11 wherein the polyvalent metal is one of aluminum, calcium, zinc and magnesium.

13. The composition of claim 10 additionally comprising a clay thixotropic thickener in an amount of about 0.1 to 2.5%.

14. The composition of claim 11 additionally comprising a clay thixotropic thickener in an amount of about 0.1 to 2.5%.

15. A method for cleaning soiled glassware and dishware in an automatic dishwashing machine which comprises contacting the soiled dishware in an automatic dishwashing machine in an aqueous washbath having dispersed therein an effective amount of the composition of claim 2.

16. A method for cleaning soiled dishware in an automatic dishwashing machine which comprises contacting the soiled glassware and dishware in an automatic dishwashing machine in an aqueous washbath having dispersed therein an effective amount of the composition of claim 9.

* * * * *